US005383563A

United States Patent [19]

Richtsfeld et al.

[11] Patent Number: 5,383,563

[45] Date of Patent: Jan. 24, 1995

[54] OUTRIGGER AND GUARD ASSEMBLY

[75] Inventors: Viktor Richtsfeld; Rudolf Weber, both of Mainburg, Germany

[73] Assignee: Caterpillar Inc., Peoria, Ill.

[21] Appl. No.: 194,775

[22] Filed: Feb. 10, 1994

[51] Int. Cl.[6] ..... B66C 23/78

[52] U.S. Cl. ..... 212/189; 267/154; 267/283; 280/764.1

[58] Field of Search ..... 212/189; 280/764.1; 267/154, 273, 283

[56] References Cited

U.S. PATENT DOCUMENTS

| | | | |
|---|---|---|---|
| 2,867,841 | 1/1959 | Baldauf | 267/154 |
| 3,067,453 | 12/1962 | Lyons | 267/154 |
| 3,365,214 | 1/1968 | Garnett | 212/189 |
| 3,490,756 | 1/1970 | Spier | 267/154 |
| 3,638,965 | 2/1972 | Cassady | 280/764.1 |

FOREIGN PATENT DOCUMENTS

| | | | |
|---|---|---|---|
| 1531139 | 10/1969 | Germany | 212/189 |
| 1173785 | 12/1969 | United Kingdom | 212/189 |

OTHER PUBLICATIONS

Caterpillar Inc. Brochure, 206B Ft Mobilbagger Fast Travel, p. 7, 1990.

*Primary Examiner*—Michael S. Huppert
*Assistant Examiner*—Thomas J. Brahan
*Attorney, Agent, or Firm*—Calvin E. Glastetter

[57] ABSTRACT

Outrigger structures are useful for supporting and stabilizing a work machine while the work machine is operating. When the work machine is in operation dirt and other debris can fall onto the moveable components of the outrigger structure thus a guard mechanism must be provided. The subject outrigger structure includes a guard member which is pivotally mounted to the top of the outrigger structure and is spring biased toward a pivotal leg member to cover a portion of the moveable components to prevent accumulation of debris on the moveable components to reduce wear on the outrigger structure. This arrangement of components provides a guard member which moves with the leg member to always maintain the guard member in position to cover the moveable components.

11 Claims, 4 Drawing Sheets

OUTRIGGER AND GUARD ASSEMBLY

TECHNICAL FIELD

This invention relates generally to an outrigger for stabilizing a work machine and more particularly to a guard which is pivotally connected to the outrigger structure to prevent debris from falling onto the hydraulic cylinder.

BACKGROUND ART

Outriggers have been used to stabilize work machines when there is a possibility of the machine tilting or overturning. The typical outrigger assembly usually has a pair of legs extendable out from the ends of a support structure and into ground surface engagement by means of a hydraulic cylinder. The ends of the support structure is typically bifurcated and the leg assembly is pivotally connected between the spaced apart ears and the rod end of the hydraulic cylinder also extends from the support structure and is connected to the leg member. One such machine has a guard which is pivotally connected to the rod end of a hydraulic cylinder and extends therefrom toward the head end of the hydraulic cylinder to only cover the rod of the hydraulic cylinder. One of the problems associated with such an arrangement is that dirt and other debris will fall into the hinge points and onto the hydraulic cylinder. The accumulation of dirt and debris damages the hydraulic cylinder and prevents movement of the leg and damages the structure.

The present invention is directed to overcoming one or more of the problems as set forth above.

DISCLOSURE OF THE INVENTION

In one aspect of the present invention an outrigger apparatus for stabilizing a work machine is provided. The outrigger apparatus includes a support structure attached to the work machine. A leg member is pivotally connected to the support structure. The leg member is moveable between a lower ground engaging position and an upper travel position. A guard member is pivotally connected to the support structure. Means for rotating the guard member in response to movement of the leg member is also provided.

The present invention provides an outrigger apparatus having a guard member which is biased toward the leg member to cover the end of the support structure. The guard member will prevent dirt and other debris from falling onto a hydraulic cylinder or collecting around the hinge points between the support structure and the leg member.

BEST MODE FOR CARRYING OUT THE INVENTION

Figure 1:
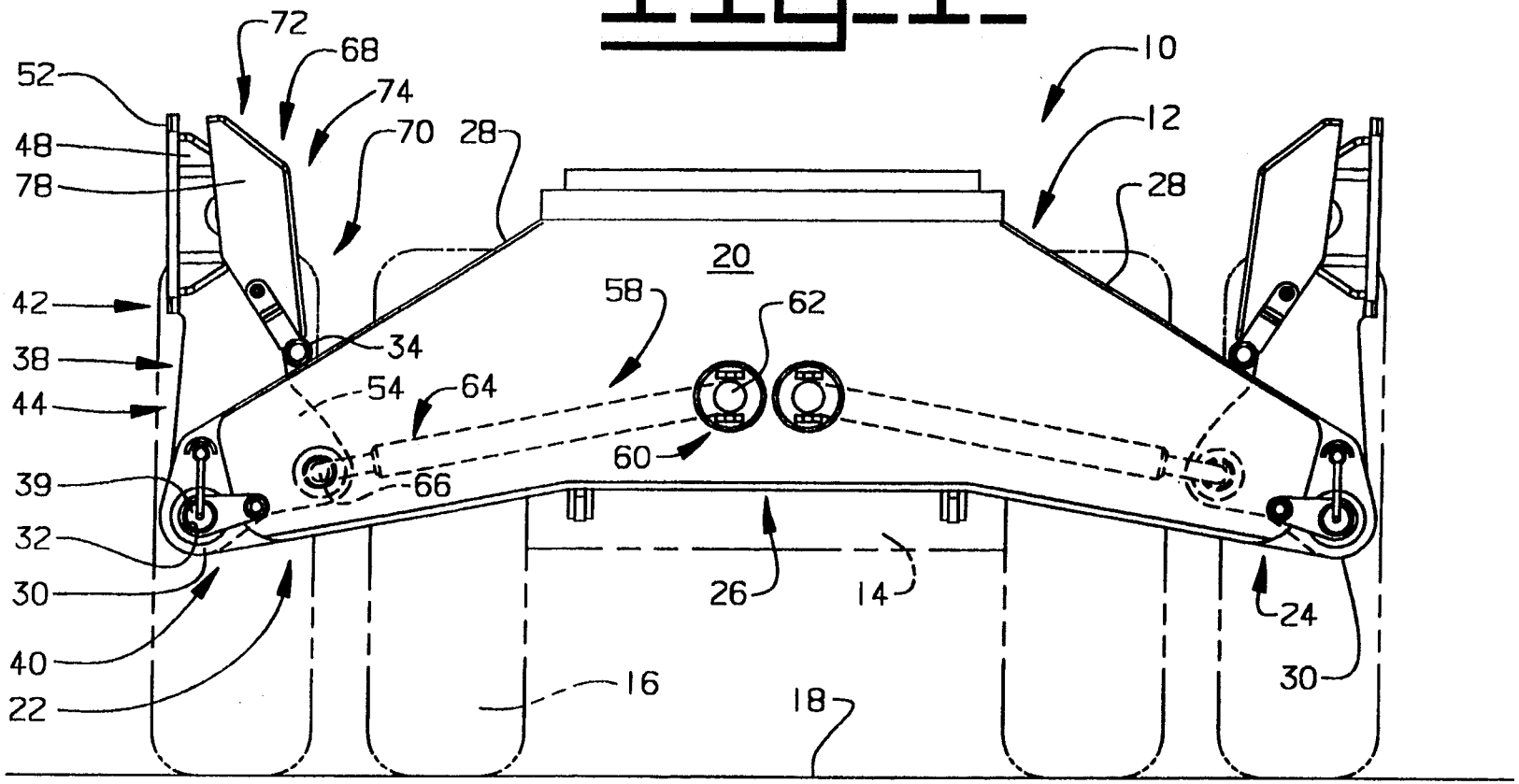
FIG. 1, is a rear view of an outrigger apparatus of the present invention with the leg members shown in the up position.
Figure 2:
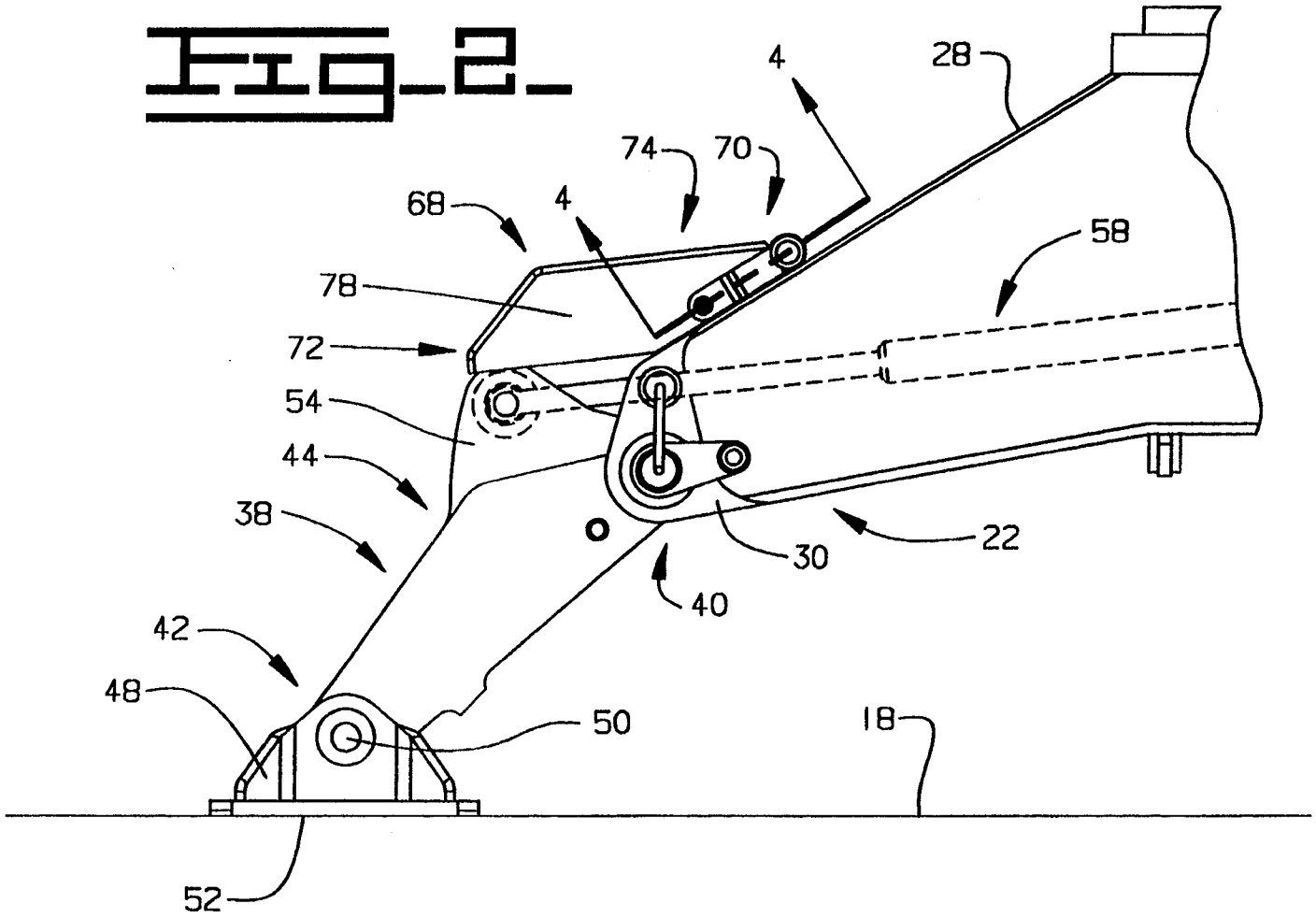
FIG. 2, is a rear view with one of the leg members shown in the down position.
Figure 3:
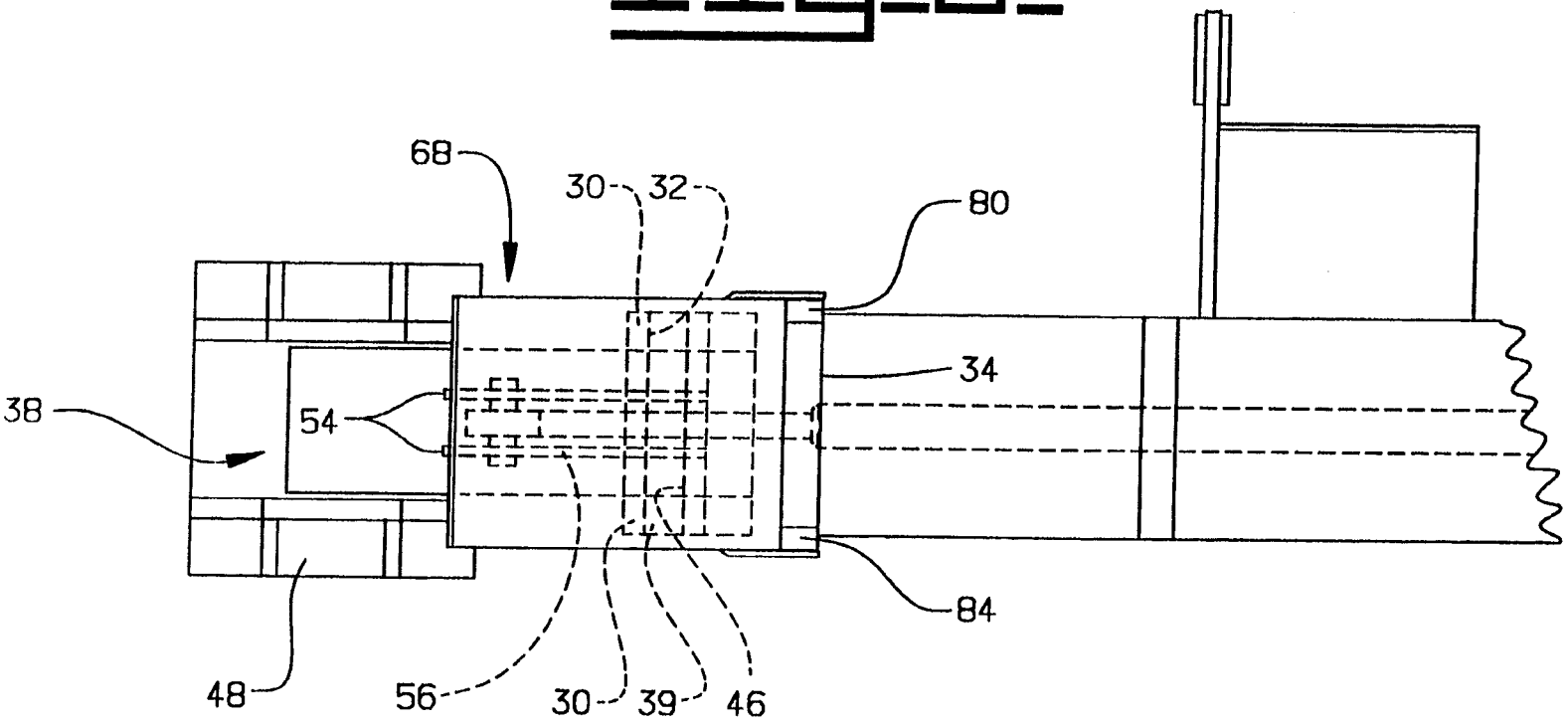
FIG. 3, is a plan view of the present invention.
Figure 4:
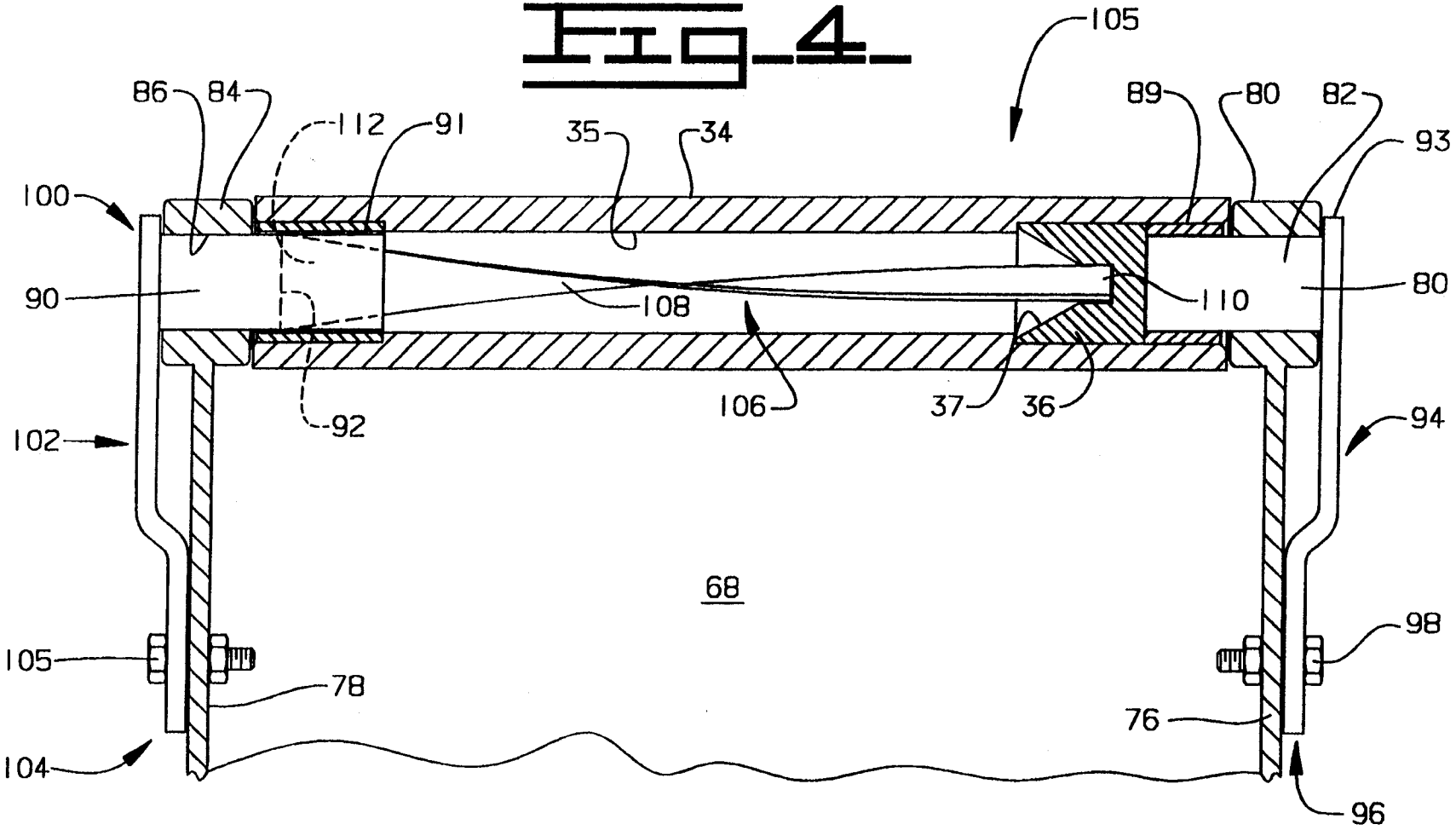
FIG. 4, is a section view as taken along line 4—4 in FIG. 2.

Referring to FIGS. 1-3, an outrigger apparatus 10 includes a support structure 12 which is attached to a work machine 14. The support structure 12 in this application is constructed to have a box shaped cross section. The work machine has a plurality of wheels 16 engageable with a ground or other travel surface 18. The support structure 12 includes an elongate frame 20 having a first end portion 22, a second end portion 24 and an intermediate portion 26 and has an upper surface 28. The first and second end portions 22, 24 are identical therefore only one end will be described. The first and second end portions 22, 24 are bifurcated and have spaced apart mounting ears 30. Each of the mounting ears 30 has a bore 32 aligned with one another. A pair of reaction tubes 34 is attached to the upper surface 28 of the elongate frame 12. One of the reaction tubes 34 is attached at the first end portion 22 and the other one of the reaction tubes 34 is attached at the second end portion 24. Each of the tubes 34 has a predetermined length. The tube 34 has a stepped bore 35, having multiple diameters, which extends the length of the tube 34. A reaction member 36 is fixedly positioned within the bore 35 of the tube. A slot 37 is formed in one end of the reaction member 36.

A leg member 38 is positioned and connected between the spaced apart mounting ears 30 by a pin 39 positioned within the bore 32 of the elongate frame 20. The leg member 38 is pivotal between a lower ground engaging position and an upper travel position. The leg member 38 has a first end portion 40, a second end portion 42 and an intermediate portion 44. The first end portion 40 has a bore 46 for receiving the pin 39 to pivotally connect the leg member 38 to the elongate frame 20. The second end portion 42 includes a stabilizing pad 48 connected thereto by a pin 50. The stabilizing pad 48 has a ground engaging surface 52. A pair of spaced apart ears 54 is mounted to the upper surface, as shown in FIG. 2, of the intermediate portion 44. The spaced ears 54 each have a hole 56 aligned with each other.

A hydraulic cylinder 58 is connected between the intermediate portion 26 of the elongate frame 20 and the intermediate portion 44 of the leg member 38. The hydraulic cylinder 58 has a head end 60 mounted within the elongate frame 20 by a pin 62 and a rod end 64 mounted to the ears 54 of the leg member 38 by a pin 66. The hydraulic cylinder 58 is actuated to pivot the leg member 38 between the lower ground engaging position and the upper travel position. The rod end 64 of the hydraulic cylinder 58, when in the down position, extends beyond the elongate frame between the spaced mounting ears 30.

A guard member 68 is pivotally attached to the tube 34. The guard member 68 has a first end portion 70, a second end portion 72 and an intermediate portion 74. A first side plate 76 extends between the first end portion 70 and the second end portion 72. A second side plate 78, opposite the first side plate 76, extends between the first end portion 70 and the second end portion 72. The first end portion 70 includes a first mounting ear 80 having a bore 82 and a second mounting ear 84 having a bore 86. The bores 82 and 86 are aligned with one another. The mounting ears 80, 84 are spaced apart a predetermined distance which is greater than the predetermined length of the tube 34. A first pin 88 passes through the bore 82 of the first mounting ear 80 and extends a predetermined distance into a bearing 89 within the bore 35 of the tube 34. A second pin 90 passes through the bore 86 of the second mounting ear 84 and extends a predetermined distance into a bearing 91 within the bore 35 of the tube 34, opposite the first pin 88. A slot 92 is formed in the end of the second pin 90 which is positioned within the bore 35. The slot 92 is positioned to face the slot 37 in the reaction member 36. The first pin 88 is welded to a first end 93 of a first retainer plate 94. A second end 96 of the retainer plate 94 is removably attached to the first side plate 76 of the guard member 68. The first retainer plate 94 can be attached by any suitable means, however in this application it is attached by a bolt 98. The end, opposite the slot 92, of the second pin 90 is welded to a first end 100 of a second retainer plate 102. A second end 104 of the second retainer plate 102 is removably attached to the second side plate 78 of the guard member 68. The second retainer plate 102 can be attached by any suitable means, however in this application it is attached by a bolt 105. Bolting the retainer plates 94, 102 to the guard member 68 insures that the guard member 68 and the pins 88, 90 rotate as a unit.

A means 105 is provided to rotate the guard member 68 in response to movement of the leg member 38. The means includes a biasing means 106 which is provided to bias the guard member 68 toward the leg member 38. In this application the biasing means 106 is a torsional spring plate 108 positioned within the bore 35 of the tube 34. The spring plate 108 has a first end 110 and a second end 112. The first end 110 is positioned within the slot 37 of the nonrotateable reaction member 36. The second end 112 is positioned within the slot 91 of the rotatable pin 90 and is rotatable with the pin 90 to twist the spring plate 108 to impart torque into the spring plate 108.

Industrial Applicability

In use of the present invention the outrigger apparatus 10 is mounted to the work machine 14. The outrigger apparatus 10 includes the support structure 12 for mounting the hydraulic cylinders 58. When the hydraulic cylinders 58 are actuated the first and second pins 84,90 of the guard members 68 are rotated within the bore 35 of the reaction tube 34. As the second pin 90 is rotated in respect to the reaction member 36 torque is imparted into or from the spring plate 108. As the leg member 38 is pivotally moved upward the second end portion 72 of the guard member 68 will be in contact with the leg member 38 and be moved upward with the leg member 38 to twist the spring plate 108 to impart torque into the spring plate 108. The spring plate 108 will, in turn, bias the guard member 68 toward the leg member. This will maintain the guard member 68 in position to cover the cylinder rod end 64, the mounting ears 30 of the bifurcated end and also the pivot connection between the support structure 12 and the leg member 38. As the leg member 38 is pivotally moved downward the torsional spring plate 108 will rotate the pin 90 and in turn rotate the guard member 68 toward the leg member 38 and keep the guard member in contact with the leg member 38.

In view of the forgoing, it is readily apparent that the structure of the present invention provides a guard member which is biased toward the leg member to provide a covering for the hydraulic cylinder and the end portion of the support structure. The guard member is pivotally connected to the reaction tube and the biasing means is connected between the reaction member within the reaction tube and the guard member. Movement of the leg member upwardly will also move the guard member toward the up position. Movement of the leg member downwardly will allow the biasing means to bias the guard member toward the down position.

Other aspects, objects and advantages of this invention can be obtained from a study of the drawing, the disclosure and the appended claims.

We claim:

1. An outrigger apparatus for stabilizing a work machine, comprising:

a support structure adapted to be attached to the work machine;

a leg member pivotally connected at a first end portion to the support structure and having a ground engaging means connected at a second end portion, the leg member being moveable between a lower ground engaging position and an upper travel position;

a guard member pivotally connected to the support structure; and biasing means for rotating the guard toward the leg member in response to movement of the leg member.

2. The outrigger apparatus of claim 1, wherein the support structure includes a first end portion, a second end portion and an intermediate portion and having an upper surface.

3. The outrigger apparatus of claim 2, wherein each of the end portions are bifurcated and each ear of the bifurcated end has a mounting bore aligned with each other.

4. The outrigger apparatus of claim 3 wherein the leg member is positioned between the ears of the end portions and is connected thereto by a pin.

5. The outrigger apparatus of claim 4 wherein a hydraulic cylinder has a first end portion connected to the intermediate portion of the support structure and a second end portion connected to the leg member.

6. The outrigger apparatus of claim 5 includes a reaction tube attached to the upper surface of the support structure.

7. The outrigger apparatus of claim 6 wherein the biasing means is connected between the reaction tube and the guard member.

8. The outrigger apparatus of claim 7 wherein the biasing means is a plate spring having a first end portion and a second end portion.

9. The outrigger apparatus of claim 8 wherein the reaction tube includes a slotted reaction member for retaining the first end portion of the plate spring.

10. The outrigger apparatus of claim 9 wherein the guard member includes a slotted pin assembly for rotating the second end portion of the plate spring.

11. An outrigger apparatus for stabilizing a work machine, comprising:

a support structure adapted to be attached to the work machine, the support structure having a bifurcated end portion having spaced apart ears and a tube attached to an upper surface;

a leg member pivotally attached between the spaced apart ears of the bifurcated end portion, the leg member being moveable between a first lower position and a second upper position;

a hydraulic cylinder connected between the support structure and the leg member;

a guard member pivotally connected to the tube of the support structure, the guard member being moveable in response to movement of the leg member between a first lower position and a second upper position; and means for biasing the guard member toward the leg member for covering the bifurcated end portion and the hydraulic cylinder for preventing the accumulation of debris within the bifurcated end portion and on the hydraulic cylinder.

* * * * *